United States Patent [19]

Wright

[11] Patent Number: 4,799,642

[45] Date of Patent: Jan. 24, 1989

[54] ANTENNA MOUNTING

[75] Inventor: George A. Wright, East Orange, N.J.

[73] Assignee: RT/Katek Communications Group, Inc., East Orange, N.J.

[21] Appl. No.: 10,347

[22] Filed: Feb. 3, 1987

[51] Int. Cl.[4] ..... E04H 12/18

[52] U.S. Cl. ..... 248/516; 248/237; 343/880; 343/890

[58] Field of Search ..... 248/514, 515, 516, 519, 248/237, 288.3, 148, 539, DIG. 10; 182/45; 52/119, 120, 149, 150, 152; 343/871, 874, 875, 878, 880, 881, 882, 888, 890, 891, 892

[56] References Cited

U.S. PATENT DOCUMENTS

| | | | |
|---|---|---|---|
| 1,107,197 | 8/1914 | Irving | 52/119 |
| 1,603,595 | 10/1926 | Hansen . | |
| 1,799,160 | 4/1931 | Franks | 52/149 |
| 2,504,291 | 4/1950 | Alderfer . | |
| 2,844,819 | 7/1958 | Andrews . | |
| 2,845,243 | 7/1958 | Mowers | 248/539 |
| 2,908,461 | 10/1959 | Coffeen . | |
| 2,933,165 | 4/1960 | Rose . | |
| 3,094,303 | 6/1963 | Belger | 343/880 |
| 3,318,559 | 5/1967 | Mullen | 343/890 |
| 3,452,956 | 7/1969 | Reed | 248/237 |
| 3,714,660 | 1/1973 | Scrafford | 343/880 |
| 3,940,771 | 2/1976 | Wild | 343/882 |
| 3,954,241 | 5/1976 | Carlson | 248/188.8 |
| 4,037,229 | 7/1977 | Dunk | 248/516 |
| 4,086,599 | 4/1978 | Vander Linden | 343/881 |
| 4,251,819 | 2/1981 | Vickland | 343/882 |
| 4,379,297 | 4/1983 | Chevallien | 343/882 |
| 4,510,502 | 4/1985 | Hovland | 248/237 |
| 4,545,557 | 10/1985 | Rogers | 248/516 |
| 4,575,034 | 3/1986 | Tobey | 248/677 |
| 4,649,675 | 3/1987 | Moldovan | 248/237 |

FOREIGN PATENT DOCUMENTS

| | | | |
|---|---|---|---|
| 526074 | 6/1956 | Canada | 248/514 |
| 705760 | 3/1931 | France | 248/516 |
| 37661 | 3/1979 | Japan | 343/882 |
| 3205 | 1/1985 | Japan | 343/880 |

*Primary Examiner*—J. Franklin Foss
*Assistant Examiner*—Robert A. Olson
*Attorney, Agent, or Firm*—Lerner, David, Littenberg, Krumholz & Mentlik

[57] ABSTRACT

An antenna support for holding an antenna on a surface such as a roof includes an elongated mast, a base structure, and struts bearing the mast to the base structure holding the mast in a generally vertical position. The struts are attached to the mast remote from the central axis of the mast, so that the struts reinforce the mast against twisting about its axis.

23 Claims, 5 Drawing Sheets

ANTENNA MOUNTING

BACKGROUND OF THE INVENTION

The present invention relates to mountings for supporting antennas above surfaces such as roof surfaces.

A mounting for securing an antenna above the surface of a building roof or the like should satisfy several demanding and apparently conflicting objectives. The mounting must be capable of supporting the weight of the antenna, and must also withstand the loads imposed by the environment, such as snow loads and wind loads applied to the antenna. Building roof structures typically are designed to take distributed loads such as the pressures exerted by snow or wind on the roof, and hence are not capable of bearing substantial concentrated loads. As it is typically impractical to reinforce an existing roof structure, the antenna mounting should be arranged to distribute the loads associated with the antenna over a large area of the roof structure.

The mounting should also be arranged to hold the antenna firmly in position, and to resist deflection of the antenna under the influence of environmental loads such as wind. This requirement is particularly stringent in the case of mountings for dish type reflector antennas. These antennas typically are aimed at a specific remote station, such as an earth satellite. The performance of such an antenna will be severely impaired if antenna movement disturbs the preset aim. Moreover, these dish antennas present very large areas to the wind, and hence are exposed to large deflecting forces. Uneven wind forces created by eddy currents or vortexes generated at the edges of a dish antenna tend to twist the antenna. The antenna mounting structure thus must be sufficiently rigid to maintain the aim of the antenna despite these forces and torsional moments.

The antenna mounting structure also should be arranged to minimize damage to the roof in installation. Thus, the mounting structure should be arranged so that it can be secured to the roof without making holes in the roof or with only a few, small holes in the roof. Further, the antenna mounting structure should be arranged so that it can be carried to the roof by one worker. Therefore, the mounting structure should be provided in the form of separate parts, none of which is heavier than about 50 lbs. However, the assembly of these parts should be simple and easy so that the mounting structure can be assembled conveniently on the roof. Moreover, the mounting structure should be arranged to compensate for differences in the pitch or slope of the roof, and to work well with flat roofs or pitched roofs. The mounting structure should also be arranged to compensate for minor irregularities in the roof surface.

All of these factors, taken together, present a formidable challenge, which has not been met satisfactorily heretofore. Accordingly, there are needs for improved antenna mounting structures, and particularly for mounting structures suitable for supporting a dish antenna on a roof structure.

SUMMARY OF THE INVENTION

The present invention provides antenna mountings which meet these needs. An antenna mounting according to one aspect of the present invention includes base structure means for defining a base structure extending over the surface and securing the base structure to the surface. The mounting also includes an elongated mast and mast connecting means for connecting the bottom end of the mast to the base structure so that the mast projects generally upwardly from the base structure. The mounting also preferably includes a plurality of elongated struts, each of which has a mast end and a base end. Strut connection means are provided for connecting the base ends of the struts to the base structure at spaced apart locations on the base structure remote from the bottom end of the mast and for connecting the mast ends of the struts to the mast remote from the bottom end of the mast so that the axis of each strut is spaced from the mast axis. For example, the mast may be an elongated tube, and the individual struts may be connected so that the struts are substantially tangential to the tube.

The struts typically extend outwardly and downwardly from the mast to the base structure, and hence reinforce the mast against tilting about its bottom end, towards and away from the base structure. Moreover, because the axes of the struts are spaced from the axis of the mast, the struts also reinforce the mast against twisting about the mast axis. Stated another way, twisting of the mast about the mast axis would tend to load at least one of the struts in tension. As the struts are quite strong in tension, they will effectively resist any such twisting. By contrast, in some antenna mounting structures utilized heretofore, struts and masts have been arranged so that the struts extend substantially radially with respect to the mast, with the strut axes intersecting the mast axis. Twisting of the mast about its own axis thus tends to bend the struts. Because the struts are relatively weak in bending, they do not effectively resist twisting of the mast. The reinforcement against twisting provided by the present invention thus offers a major and fundamental advantage. Moreover, this improved torsion resistance is attained by more efficient use of the struts, rather than by adding separate torsion reinforcing elements.

Preferably, the base structure means includes a plurality of elongated base members, each having a central end and a peripheral end. Base member connection means may be provided for attaching the central ends of the base members to one another at a central location so that the peripheral ends of the base members extend away from the central location. Preferably, the base members extend substantially in a base plane, and project substantially radially from the central location. The mast connecting means can be arranged to connect the bottom end of the mast to the base structure adjacent the central location.

The strut connection means preferably is arranged to attach the base end of each strut to one of the base members adjacent the peripheral end of the base member. Thus, each of the struts projects outwardly from the mast generally along one of the base members and also projects downwardly from the mast towards the plane of the base members.

In a particularly preferred arrangement, the mast connection means is arranged to allow tilting of the mast towards and away from the plane of the base members. The struts, when connected between the base members and mast, resist tilting of the mast and hence fix the mast relative to the base members. Adjustment means are provided for adjusting the positions of the mast ends of the struts relative to the base members to thereby adjust the tilt of the mast relative to the base members. Where the mounting is installed on top of a flat roof, and the plane of the base members is precisely horizontal, the mast can be adjusted to stand perpendicular to the plane of the base members. Where the mounting is positioned on a pitched roof, the mast can be positioned at an oblique angle with respect to the plane of the base members, so that the mast remains exactly vertical.

The adjustment means may include means for adjusting the lengths of the individual struts, or devices for adjusting the positions of the base ends of the struts along the individual base members, or both. Most preferably, each base member defines a plurality of discrete, separate attachment points spaced along the length of the member, and the strut connecting means is arranged to connect the base end of each strut to one of these attachment points. Thus, by selecting appropriate attachment points, the tilt of the mast with respect to the base plane can be adjusted. Preferably, fine adjustment means are also provided, and these allow some adjustment of the base end positions with respect to the selected attachment points.

The elements of the mounting structure preferably are provided in kit form, disassembled from one another. Thus, the base members can be carried onto the roof separately from one another and separately from the mast and struts. These components can be connected to one another by the installer on the roof surface. Preferably, the mounting also includes feet for attachment to the peripheral ends of the base members, and the feet are hollow so that each foot defines a chamber. Weights separate from the rest of the mounting structure can be carried to the roof surface and placed within the chambers in the individual feet so that the weights aid in securing the mounting structure to the roof. The feet may have generally planar surfaces so that adhesive can be applied between the feet and the roof surface. Because the antenna mounting according to this aspect of the present invention can transmit the loads applied by the antenna to the roof at widely spaced locations, and distribute the loads applied at each such location over a substantial area, stresses on the roof are minimized. Moreover, the entire mounting structure can be secured to the roof surface without penetrating the roof surface at all or at most, with only a few minor penetrations for small securement bolts or nails.

The mounting structures according to preferred embodiments of the present invention thus provide a strong and rigid antenna mountings which can be conveniently installed on a roof surface by one man without damage to the roof but which nonetheless will support a large antenna such as a six foot (1.8 meter) diameter dish antenna. As further set forth hereinbelow, structural features of the preferred embodiments facilitate rapid assembly of the antenna mounting. These and other objects, features and advantages of the present invention will be more readily apparent from the detailed description of the preferred embodiments set forth below.

DETAILED DESCRIPTION OF THE PREFERRED EMBODIMENTS

Figure 7:
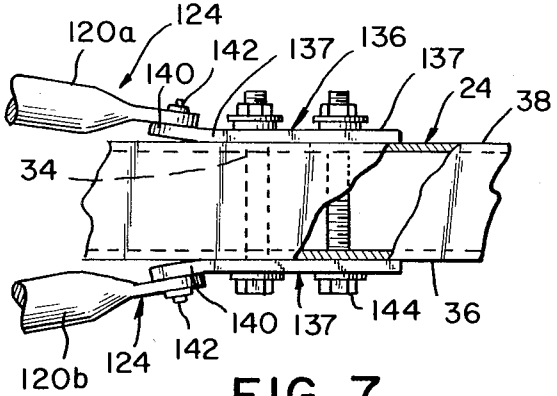
FIG. 7 is a fragmentary, partially sectional view taken along line 7—7 in FIG. 6.
Figure 2:
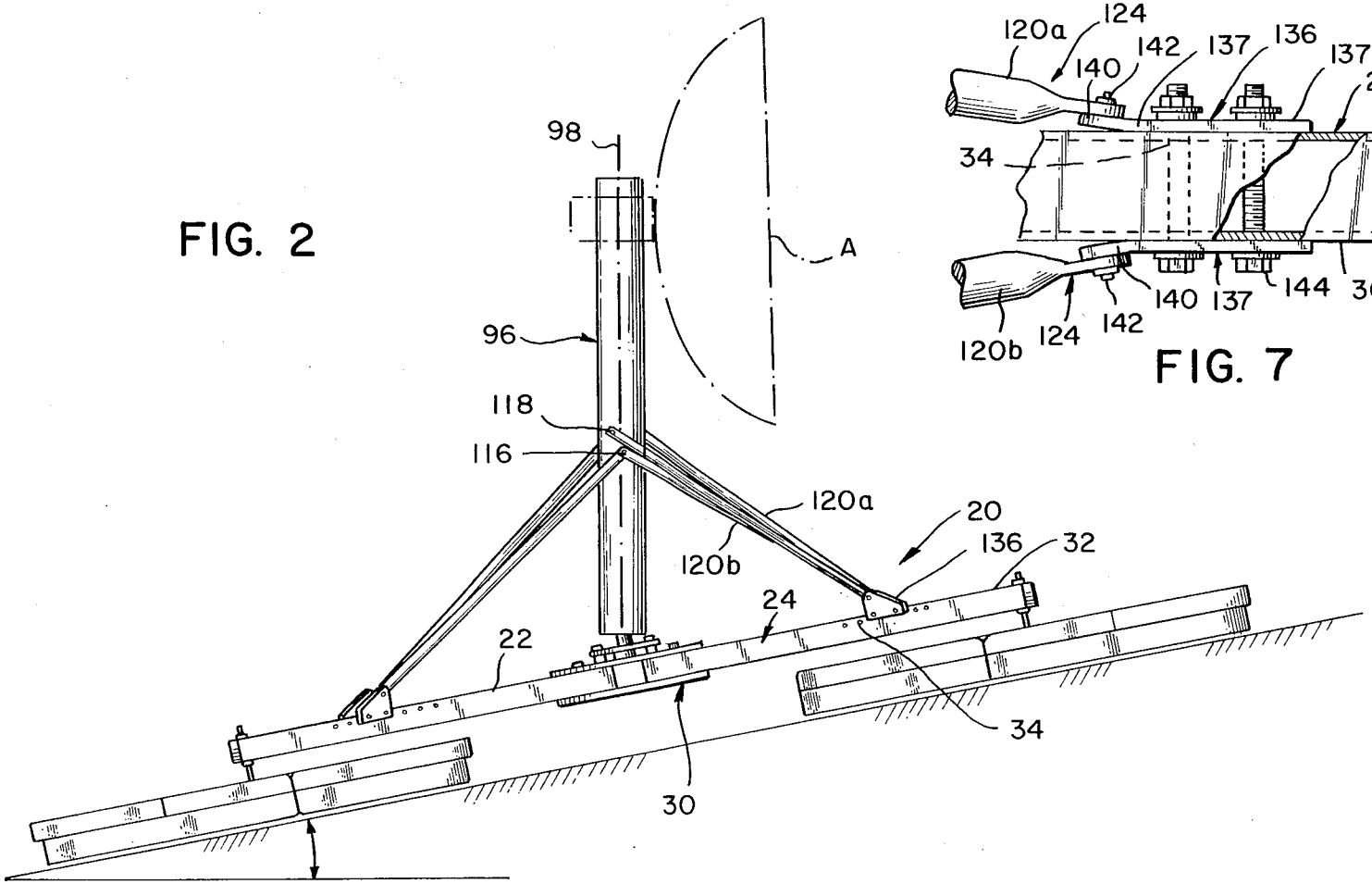
FIG. 2 is an elevational view of the mounting shown in FIG. 1 disposed on a sloping roof surface.
Figure 3:
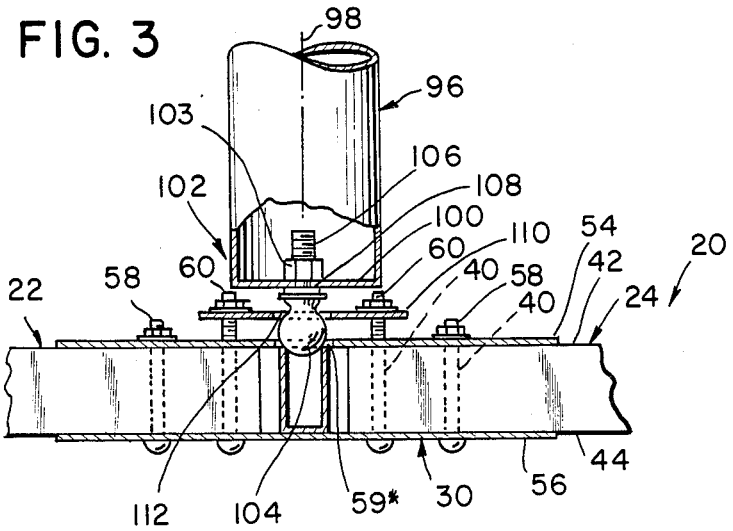
Figure 6:
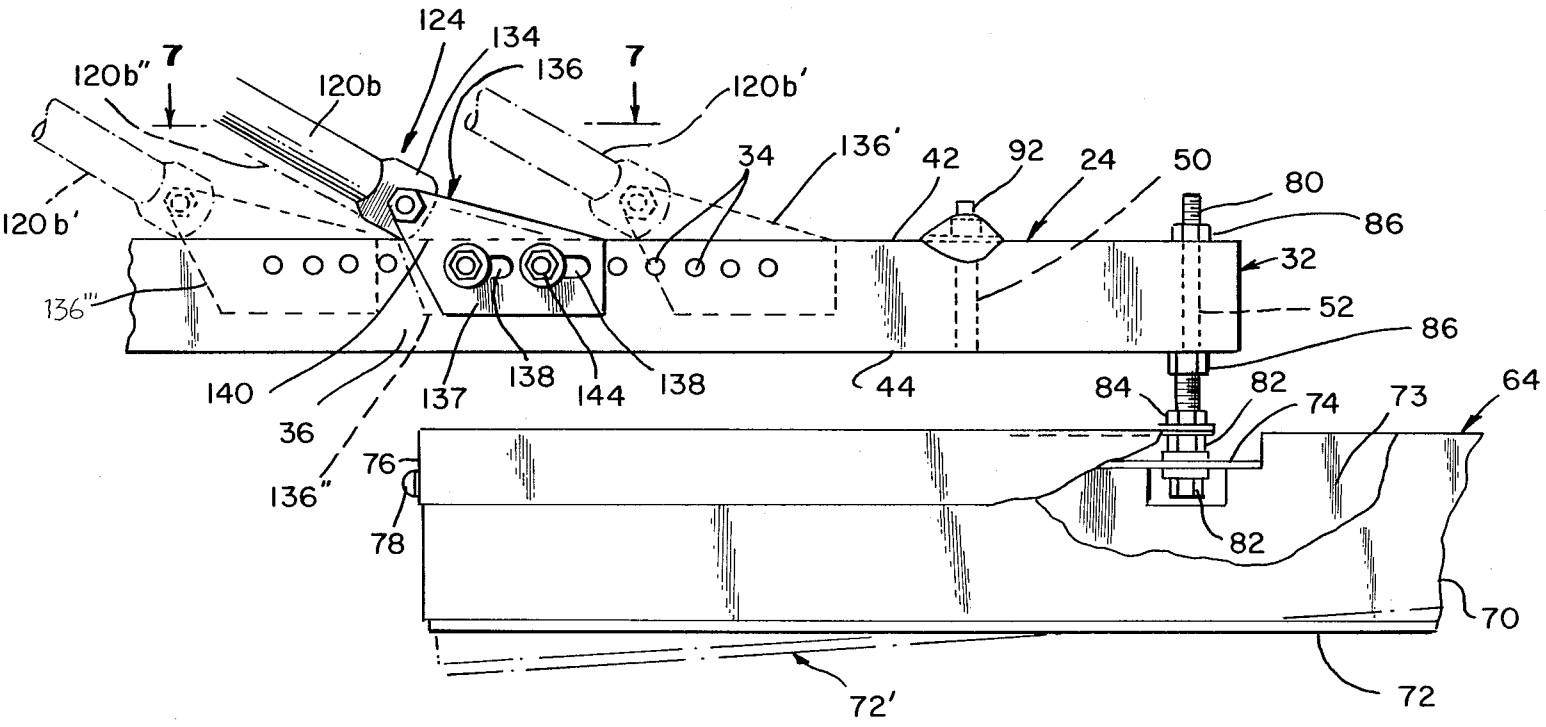
FIG. 6 is a fragmentary elevational view on an enlarged scale of the mounting shown in FIGS. 1–5.

A mounting according to one embodiment of the present invention includes a base structure 20 which includes four elongated base members 22, 24, 26 and 28. Base member 24 has a central end 30 and a peripheral end 32 (FIG. 2), a long axis extending between these ends and a plurality of mounting holes 34 extending through the base member adjacent peripheral end 32. Base member 24 is generally rectangular in cross section, and the holes 34 extend through two opposed faces 36 and 38 of the rectangular cross section (FIG. 7). Base member 24 also has tie bolt holes 40 extending through the other two opposed faces 42 and 44 of the rectangular cross section adjacent the central end 30 of the member (FIG. 3). The base member 24 also is provided with a tie rod securement bolt hole 50 and a foot mounting hole 52 extending through faces 42 and 44, adjacent the peripheral end 32 of the member (FIG. 6). Each of the other base members 22, 26 and 28 is substantially similar to member 24.

The base structure also includes a base plate 54 defining a socket hole 59, clamping plate 56 and tie bolts 58 and 60. When the base structure is assembled on the roof, bolts 58 and 60 secure the central ends 30 of the individual members 22, 24, 26 and 28 to one another so that the base members extend generally radially outwardly from socket hole 59 in a common base plane as shown. When secured to one another, base members 24 and 28 extend generally perpendicular to base members 22 and 26.

The base structure further includes four feet 62, 64, 66 and 68. Foot 64 includes a large rectangular tray 70 having a generally planar bottom surface and defining a hollow space or chamber 73. Tray 70 is provided with a bracket 74 extending across the top of chamber 73 adjacent the center of the tray. Foot 64 also includes a cover 76 and screw 78 for releasably securing the cover to the top of the tray. A threaded post 80 is releasably secured to the bracket 74 of the tray by nuts 82 and appropriate lock washers (not shown). An additional nut 84 is also provided on post 80 for further releasably securing cover 76 to tray 70. Additionally, supporting nuts 86 are also threadedly engaged with post 80. Each of the other feet 62, 66 and 68 includes a generally similar assemblage of parts. When the mounting structure is assembled, the post 80 of foot 64 is received in the foot mounting hole 52 of base member 24 so that the foot is secured to the base member adjacent the peripheral end 32 of the base member. Supporting nuts 86 are engaged with the faces 42 and 44 of base member 24 so that the base member is supported at the desired height above tray 70. The connection between post 80 and tray 70 allows limited tilting movement of the tray relative to the post so that the bottom surface 72 of the tray can cant or tilt slightly relative to the base member, as indicated at 72'. One of ordinary skill in the art will readily recognize that such tilting of the tray 70 can be facilitated by providing some "play" or "slop" at the connection between post 80 and tray 70. Thus, the skilled mechanic will provide the requisite clearance between nuts 82 and bracket 74 to permit the limited tilting movement. The other feet 62, 66 and 68 are secured in substantially the same way to the peripheral ends of the other base members 22, 24 and 28, respectively.

Four tie rods 90 (FIG. 1) are also provided. Each of these tie rods is connected to the peripheral ends of two adjacent ones of the base members. Thus, one tie rod 90 extends between base members 22 and 24 another between base members 24 and 26 and so on. As will be appreciated, two tie rod ends overlap at the peripheral end of each base member. These ends are connected to the base member by rod securement bolts 92 extending through holes in the tie rod ends and extending through the rod securement bolt hole 50 of the base member.

The mounting also includes an elongated, cylindrical tubular mast 96 having a mast axis 98. The tubular mast has an end plate 100 at its bottom end 102. A nut 103 is welded to end plate 100 so that the nut forms a threaded socket coaxial with the mast axis 98 and opening through a hole 108 in end plate 100. A ball 104 is fixed to a threaded ball shaft 106, which in turn is threadedly engaged in nut 103. A locking plate 110 is provided with a generally circular socket hole 112 and other bolt holes (not shown) aligned with the bolt holes in plates 54 and 56. Locking plate 110 is disposed above base plate 54 and secured by nuts on some of the tie bolts 60. Ball 104 is disposed between locking plate 110 and base plate 54, so that the ball and ball shaft 106 protrude upwardly through hole 112. The diameter of socket hole 112 in locking plate 110, and the diameter of socket hole 59 in base plate 54 are slightly less than the diameter of ball 104. Thus, ball 104 is trapped between these plates, and the plates cooperatively define a socket for receiving the ball. The engagement of the ball in this socket secures mast 96 to the base structure 20 with the mast projecting generally upwardly from the plane of the base members. However, mast 96 is tiltable over a predetermined tilt range in any direction with respect to the plane of the base members. Also, mast 96 can be rotated as desired about mast axis 98 relative to the base structure.

Mast 96 is provided with holes (not shown) in its tubular wall for accommodating a threaded lower support shaft 116 and a threaded upper support shaft 118. The holes for threaded shaft 116 are disposed closer to the bottom end 102 of the mast. As best appreciated with reference to FIG. 5, the support shafts 116 and 118 extend through tubular mast 96 in directions which are perpendicular to one another and which are also perpendicular to mast axis 98.

Figure 1:
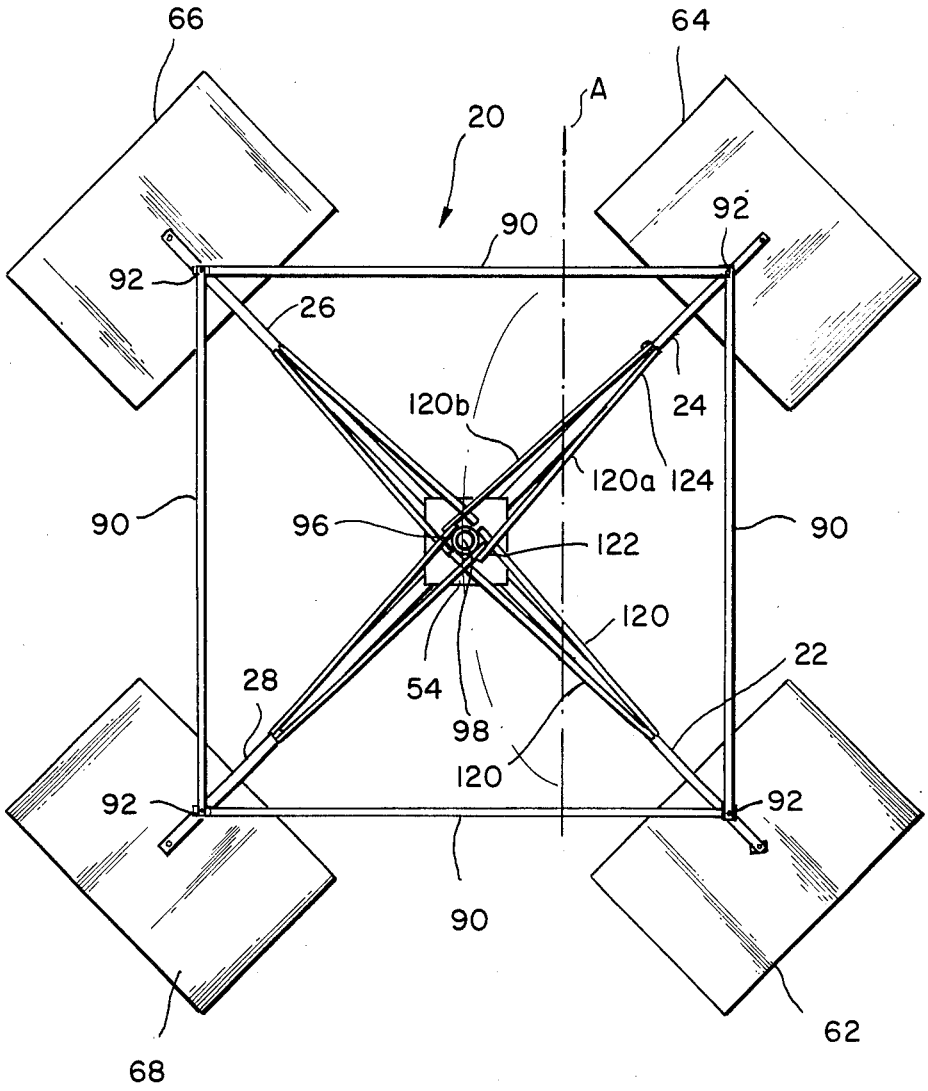
FIG. 1 is a top view of a mounting according to one embodiment of the present invention.
Figure 5:
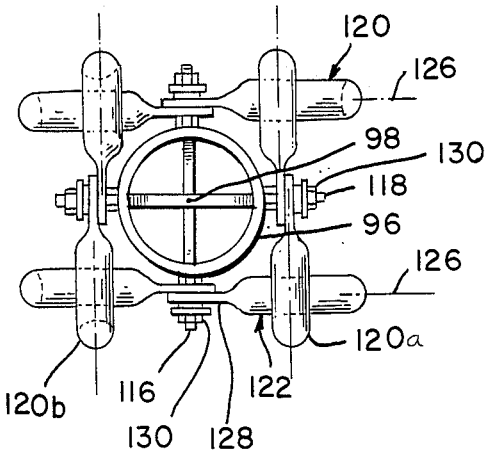
FIG. 5 is a fragmentary sectional view taken along line 5—5 in FIG. 4.
Figure 4:
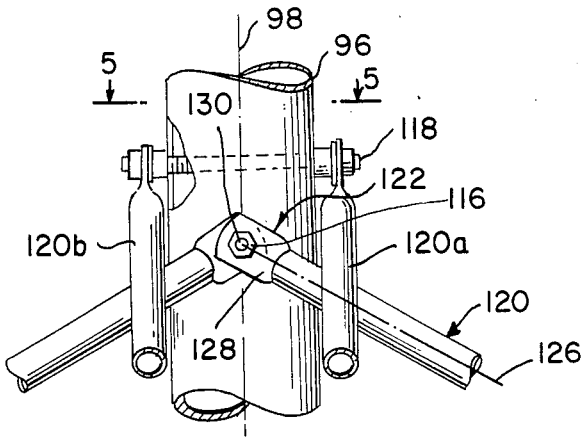
FIGS. 3 and 4 are fragmentary, partially sectional views on an enlarged scale of the mounting shown in FIGS. 1 and 2.

Eight elongated tubular struts 120 are provided. Each strut has a mast end 122 and a base end 124 (FIG. 1). Each of tubular elongated struts 120 defines a strut axis 126, which is the neutral axis of the strut in buckling or bending. The mast end 122 of each strut is provided with a flattened portion 128 having a hole (not shown). The flattened ends 128 of the struts are received on the strut support shafts 116 and 118 and secured by nuts 130. Each strut 120 extends generally transverse to the strut support shaft 116 or 118 to which that particular strut is connected. Four struts 120 are connected to lower support shaft 116, two on each side of mast 96, and four other struts 120 are connected to upper support shaft 118. Two struts connected to the same support shaft project outwardly and downwardly from the support shafts towards the peripheral end of each base member 22, 24, 26 and 28. For example, struts **120*a* and 120*b* project from upper support shaft 118 outwardly and downwardly towards the peripheral end of base member 24. These two struts constitute a pair of struts associated with base member 24. The two struts of this pair are connected t the peripheral wall of mast 96 at substantially diametrically opposed locations on the mast peripheral wall. These pair of struts associated with the other base members are likewise connected at substantially diametrically opposed locations on the mast. As best appreciated with reference to FIGS. 4 and 5, the struts 120 attached to upper shaft 118 cross above the struts 120 connected with lower shaft 116. As also seen in FIG. 5, the struts are connected to mast 96 remote from mast axis 98, so that the strut axes 126 are remote from mast axis 98. That is, the strut axes 126 do not intersect mast axis 98**.

As best seen in FIGS. 6 and 7, each of the struts 120 has a flattened portion 134 at its base end. Brackets 136 are provided for connecting the base ends 124 of each strut to the associated one of the base members. Each bracket 136 includes a plate portion 137 having a pair of coaxial, elongated slots 138 and an upstanding tab portion 140. The tab portion 140 of each bracket is bent slightly out of the plane of the plate portion 137. A bolt 142 secures the flattened portion 134 at the base end 124 of each strut to the tab portion 140 of a bracket 136. The brackets 136 are engaged with the base members so that slots 138 aligned with particular ones of the holes 34 on each base member. Bracket fastening bolts 144 extend through those of holes 34 which are aligned with slots 138, and nuts on these bolts 144 secure the brackets 136 to the base members. The brackets 136 associated with the struts 120A and 120B are connected on the same bracket fastening bolts 144, so that the base ends of struts 120A and 120B lie at substantially the same location along the length of base member 24. Also, struts **120*a* and 120*b* slope away from one another to their connections at mast 96**. The same is true of the other pairs of struts associated with the other base members.

As will be appreciated with reference to FIG. 6, the plural discrete, spaced apart holes 34 provided along the lengthwise axis of base member 24 provide a plurality of discrete attachment points for the brackets 136 and hence for the struts **120*a* and 120*b* associated with the base member. Thus, by removing the bracket fastening bolts 144, the brackets shown in FIG. 6 can be displaced to the alternate locations shown in broken lines at 136'. Displacement of the bracket along the axis of base member 24 likewise will shift strut 120*b* to the alternate positions indicated at 120*b'*. Moreover, slots 138 provide for fine adjustment of the position of the base ends 124 of each strut 120 along the length of the associated base member. By loosening bolts 144, bracket 136 and strut 120*b* can be moved slightly towards or away from the peripheral end 32 of the strut as indicated at 120*b''* in broken lines. Thus, the base end 124 of strut 120*b* can be connected to any of the individual attachment points provided by holes 34** and the position of the strut can be varied slightly over a predetermined limited range with respect to the particular attachment point utilized. The other struts can be adjusted with respect to the base members in the same way.

As will be appreciated, adjustment of the base ends of the struts along the associated base members, towards and away from the central ends of the respective base members, also adjusts the positions of the mast ends of the struts. Such adjustment thus adjusts the tilt of mast 96 relative to the plane defined by the base structure 20. As shown in FIG. 2, the mounting is installed on a pitched roof, with base member 24 extending towards the higher portion of the roof and base member 22 extending towards the lower portion. To maintain the axis 98 of mast 96 precisely vertical, the brackets 136 and the associated struts 120 on base member 24 are connected to base member 24 at a greater distance from the mast than the brackets 136 and struts 120 associated with bas member 22. Thus, the struts 120 serve to hold the mast in a precisely tilted orientation with respect to the plane of the base members.

In use, an antenna A can be mounted on mast 96 adjacent its top end. The structure provides an extremely rigid, secure mounting for the antenna. As best appreciated with reference to FIGS. 5 and 1, the struts will resist twisting of the mast about axis 98. Any twisting movement of the mast will necessarily impose tensile loads on four of the struts. Moreover, any tilting movement of the mast towards or away from the plane of the base members would stress at least two of the struts 120 in tension. Because the struts are connected to the base members adjacent the peripheral ends of the base members, and hence adjacent the feet, the bending loads in the base members which might be imposed by tilting or twisting forces on the antenna will be limited.

Preferably, the mounting is supplied in the form of disassembled components, i.e., as a kit, and the various components are assembled to one another on the roof. Each of the individual components preferably is light enough to be handled and brought to the roof by one man. Desirably, each component or subassembly in the mounting as supplied weighs about 50 lbs. or less. Because substantially all of the assembly required consists merely of bolting components to one another, and because the positions of the various elements are adjustable after assembly, the assembly can be performed simply and easily. Ordinarily, each of the feet 62, 64, 66 and 68 is filled with weights, such as concrete or the like after transportation to the roof. The bottom surfaces of the feet may also be coated with a mastic adhesive or the like to provide a bond with the roof surface. These measures provide effective securement of the mounting to the roof surface. If desired, the security of mounting can be increased by driving fasteners through the feet into the roof. Because each foot is free to tilt slightly with respect to the associated base element, the feet can effectively compensate for minor irregularities in the roof surface. Thus, the bottom surface of each foot can remain in close contact with the roof surface even where a portion of the roof surface is canted or pitched out of the true plane of the roof. This increases the efficiency of any adhesive utilized. Also, because each foot can be adjusted upwardly or downwardly with respect to the associated base member by adjusting nuts 86 (FIG. 6), the mounting can be stabilized on a roof surface, with all feet in contact, even where the roof surface deviates substantially from a true planar surface.

Figure 8:
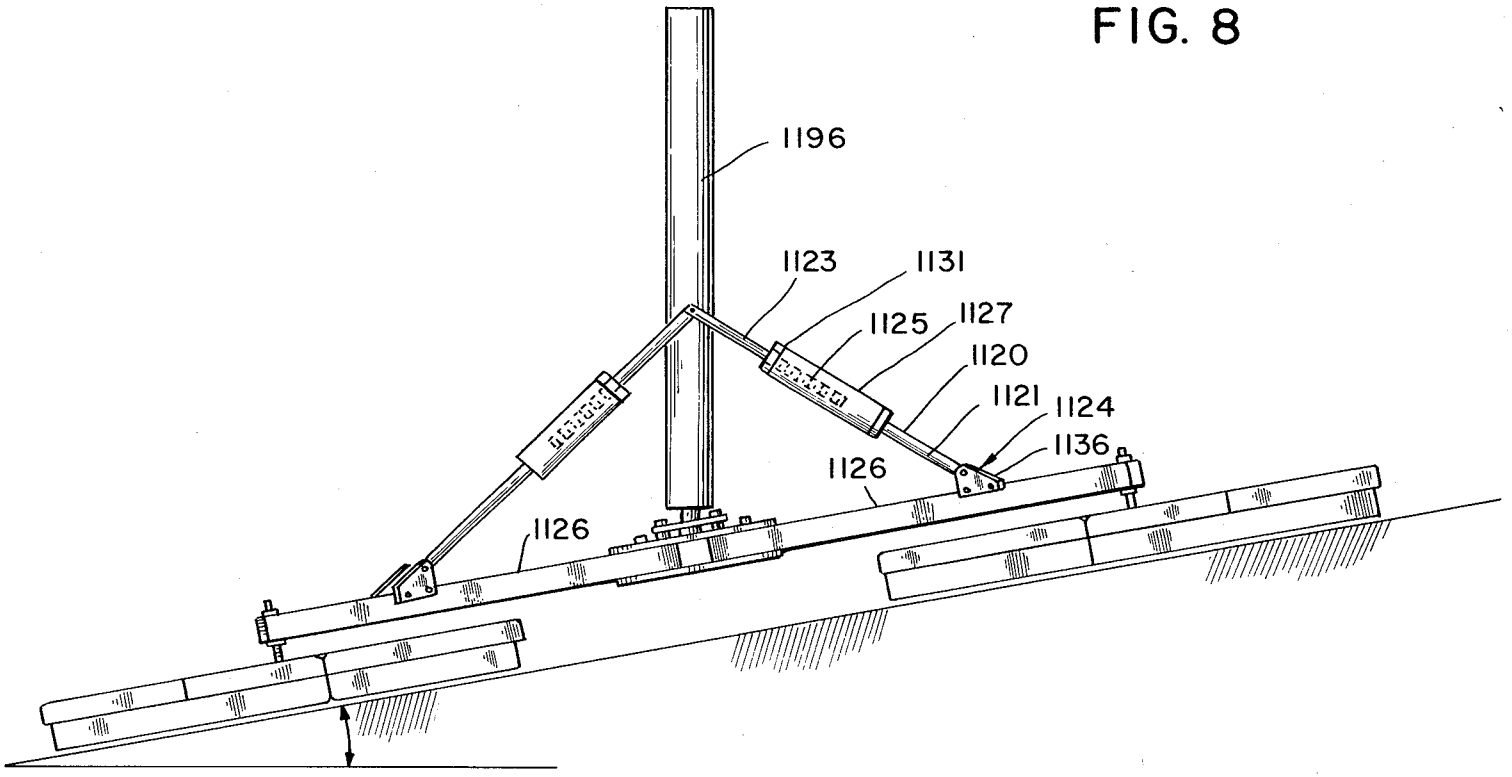
FIG. 8 is a view similar to FIG. 2 but depicting a mounting according to another embodiment of the present invention.

The mounting illustrated in FIG. 8 is substantially the same as the mounting described above with reference to FIGS. 1–7, except that the base ends 1124 of the struts 1120 are connected to the associated base members by brackets 1136 which are mounted at a fixed position along the length of each base member 1126. Each strut 1120 includes a base end member 1121 and a mast end member 1123. The mast end member 1123 of each strut is provided with male threads 1125, whereas an elongated female threaded collar 1127 is connected to each base end member 1121 so that the axis of collar 1127 is coaxial with the axis of base end member 1121. Each collar 1127 is fixed against displacement along the axis of base end member 1121 but is rotatable with respect to the base end member. The threads 1125 on mast end member 1123 are threadedly engaged in the female threads of collar 1127. Thus, the length of each strut 1120 can be varied. A lock nut 1131 is carried on threads 1125.

As will be appreciated, varying the lengths of the individual struts 1120 will move the mast ends of the struts and hence will control the tilt of the mast 1196 relative to the plane of the base elements. Once the appropriate tilt has been achieved, the lengths of the individual struts are locked by actuation of lock nuts 1131.

The adjustable length struts as shown in FIG. 8 can be combined with the base end strut adjustment used in the embodiment of FIGS. 1–7. For example, the variable length struts may be arranged to provide only a limited range of adjustment, suitable for fine adjustment of the mast tilt, whereas the discrete separate holes or attachment points provided along the length of the base members may be used for coarse adjustment of the mast tilt. Other variations and combinations of the features described above can be employed. For example, more or fewer struts can be employed. However, it is particularly desirable to utilize at least three struts, with at least one strut associated with each base element and extending outwardly along each base element. As these and other variations, combinations and modifications of the features described above can be utilized without departing from the invention as defined in the claims, the foregoing description of the preferred embodiments should be taken by way of illustration rather than by way of limitation of the invention.

What is claimed is:

1. An antenna mounting for supporting an antenna above a surface comprising:

(a) base structure means for defining a base structure extending over the surface and securing said base structure to the surface;

(b) an elongated tubular mast having a mast axis, a bottom end and a top end;

(c) mast connection means for connecting said bottom end of said mast to said base structure so that said mast projects generally upwardly from said base structure;

(d) a plurality of elongated struts, each having a strut axis, a mast end and a base end; and (e) strut connection means for connecting the base ends of said struts to said base structure at spaced apart locations thereon remote from the bottom end of said mast and connecting the mast ends of said struts to said mast remote from the bottom end of the mast so that said strut axes are tangential to said tubular mast, whereby said struts reinforce said mast against twisting about said mast axis and against tilting towards or away from said base structure.

2. A mounting as claimed in claim 1 wherein said base structure means includes a plurality of elongated base members each having a central end, a peripheral end and a long axis, and base member connection means for connecting said central ends of said base members adjacent a central location so that peripheral ends of said members extend away from said central location, said mast connection means being operative to connect said bottom end of said mast to said base structure adjacent said central location.

3. A mounting as claimed in claim 2 wherein said strut connection means includes means for attaching the base end of each said strut to one of said base members adjacent the peripheral end thereof, whereby each of said struts projects outwardly from said mast along one of said base members.

4. A mounting as claimed in claim 3 wherein said base member connection means is operative to connect said base members so that the base members define a base plane, said mast connection means is operative to connect said bottom end of said mast to said base structure so that said mast is tiltable relative to said base plane, said mounting further comprising adjustment means for adjusting the positions of said mast ends of said struts relative to said base members to thereby vary the position of said mast in tilt.

5. A mounting as claimed in claim 4 wherein at least one of said struts is an adjustable-length strut, said adjustment means including strut length variation means for varying the length of said adjustable strut between said mast end and said base end of said adjustable strut.

6. A mounting as claimed in claim 5 wherein each said adjustable-length strut includes a male threaded element and a female threaded element extending lengthwise along the strut, said male threaded element being engaged with said female threaded element, and means for selectively locking said threaded elements against rotation relative to one another.

7. A mounting as claimed in claim 4 wherein said adjustment means includes means for varying the position of at least one of said base ends of said struts along the length of the associated one of said base elements.

8. A mounting as claimed in claim 7 wherein each of said base members includes means for defining a plurality of discrete attachment points spaced apart from one another along the length of the member, said strut connection means including means for connecting the base end of each said strut to any one of the attachment points along the associated one of said base members, said adjustment means including said means for connecting said base ends of said struts to any one of said attachment points.

9. A mounting as claimed in claim 8 wherein said adjustment means also includes length adjustment means for continuously varying the length of each said strut over a predetermined, limited range to thereby provide fine adjustment of the positions of said mast ends of said struts with respect to said base structure.

10. A mounting as claimed in claim 8 wherein said adjustment means includes fine adjustment means for varying the position of the base end of each said strut with respect to the attachment point to which said base end is connected over a predetermined limited range to thereby provide fine adjustment of the positions of said struts relative to said base structure.

11. A mounting as claimed in claim 10 wherein each said elongated base member has a plurality of holes extending therethrough transverse to the long axis of said member, said strut connection means including a plurality of brackets, each said bracket having an elongated slot, said strut connection means including means for connecting said brackets to said base ends of said struts so that the slot of each said bracket can be aligned with one of said holes in one of said base members, said strut connection means also including a plurality of fasteners adapted to fit within said slots and said holes, said fine adjustment means including said slots in said brackets.

12. A mounting as claimed in claim 4 wherein said mast connection means is operative to connect said mast to said base structure so that said mast is pivotable with respect to said base structure in all directions transverse to said mast axis.

13. A mounting as claimed in claim 12 wherein said mast connection means is operative to connect said bottom end of said mast to said base structure so that said mast is rotatable with respect to said base structure about said mast axis, said struts and said strut connection means restraining said mast against such rotation when said struts are connected to said mast and said base structure.

14. A mounting as claimed in claim 4 wherein said mast connection means includes a generally spherical ball, means for connecting said ball to one of said mast and said base structure, and means for defining a socket adapted to receive said ball on the other one of said mast and said base structure.

15. A mounting as claimed in claim 14 wherein said means for connecting said ball includes a ball shaft having one end connected to said ball, and means for connecting the other end of said ball shaft to said mast so that said ball shaft projects from the bottom end of said mast, said means for defining a socket including a base plate, a locking plate defining a circular hole of diameter less than the diameter of said ball, and means for securing said locking plate and said base plate to said base members so that said locking plate is disposed above said base plate and said ball is disposed between said locking plate and said base plate.

16. A mounting as claimed in claim 15 wherein each of said base members has tie bolt holes adjacent its central end, said means for securing said locking plate and base plate including a plurality of clamping bolts and a clamp plate, said clamping bolts extending through said clamping plate and said base plate, at least some of said clamping bolts also extending through said locking plate when said base members are connected to one another and said mast is connected to said base structure.

17. A mounting as claimed in claim 1 wherein said strut connection means includes a lower strut shaft extending through said tubular mast in a first direction transverse to said mast axis, an upper strut shaft extending through said tubular mast in a second direction transverse to said mast axis and transverse to said first direction, said upper strut shaft being disposed further from said bottom end of said mast than said lower strut shaft, said strut connecting means also including means for connecting said struts to said strut shafts so that the struts connected to each said strut shaft extend transverse to the strut shaft, whereby the struts connected to said upper strut shaft will extend transverse to the struts connected to said lower strut shaft and the struts connected to said upper strut shaft will cross above the struts connected to said lower strut shaft.

18. A mounting as claimed in claim 17 wherein said strut connecting means is operative to connect said struts to said mast so that a pair of said struts extends from said mast towards the peripheral end of each said elongated base member, and the mast ends of the struts in each such pair are attached to diametrically opposed locations on the periphery of said tubular mast.

19. A mounting as claimed in claim 3 wherein said base structure means includes a plurality of tie rods and means for connecting said tie rods to said base members adjacent the peripheral ends thereof so that each said tie rod extends between two adjacent ones of said base members.

20. A mounting as claimed in claim 3 wherein said base structure means includes a plurality of feet and means for attaching said feet to said base members adjacent the peripheral ends of said base members so that one of said feet is disposed beneath the peripheral end of each said base member.

21. A mounting as claimed in claim 20 wherein said means for attaching said feet includes means for adjusting the position of each said foot upwardly and downwardly with respect to the associated one of said base members.

22. A mounting as claimed in claim 21 wherein each said foot defines a generally planar bottom surface, said means for attaching said feet including means for permitting pivotal motion of each said foot with respect to the associated one of said base members to thereby vary the disposition of said bottom surface with respect to such base member.

23. A mounting as claimed in claim 22 wherein each said foot defines a chamber whereby weights may be inserted into said feet to secure the mounting to the surface.

* * * * *